US009517370B2

(12) United States Patent
Murray

(10) Patent No.: US 9,517,370 B2
(45) Date of Patent: Dec. 13, 2016

(54) DISTRIBUTION OF FIRE SUPPRESSING AGENT IN A STOVETOP FIRE SUPPRESSOR AND METHOD

(71) Applicant: Donald W Murray, Arlington, TX (US)

(72) Inventor: Donald W Murray, Arlington, TX (US)

(73) Assignee: WilliamsRDM, Inc., Fort Worth, TX (US)

( * ) Notice: Subject to any disclaimer, the term of this patent is extended or adjusted under 35 U.S.C. 154(b) by 65 days.

(21) Appl. No.: 14/246,024

(22) Filed: Apr. 4, 2014

(65) Prior Publication Data

US 2015/0238788 A1 Aug. 27, 2015

Related U.S. Application Data

(60) Provisional application No. 61/943,017, filed on Feb. 21, 2014.

(51) Int. Cl.

| | |
|---|---|
| ***A62C 3/00*** | (2006.01) |
| ***A62C 35/08*** | (2006.01) |
| ***F42B 3/26*** | (2006.01) |
| ***A62C 37/12*** | (2006.01) |
| ***A62C 37/14*** | (2006.01) |

(52) U.S. Cl.

CPC ..... *A62C 3/006* (2013.01); *A62C 35/08* (2013.01); *A62C 37/12* (2013.01); *A62C 37/14* (2013.01); *F42B 3/26* (2013.01)

(58) Field of Classification Search

CPC ..... A62C 3/006; A62C 35/08; F42D 1/04; F42D 1/043; F42B 3/26

See application file for complete search history.

(56) References Cited

U.S. PATENT DOCUMENTS 1,366,873 A * 1/1921 Carpenter ..... A62C 35/605 169/29
1,766,912 A * 6/1930 Laengel ..... A62C 35/605 169/26

(Continued)

FOREIGN PATENT DOCUMENTS

AU 2015219465 9/2015

OTHER PUBLICATIONS

PCT/US2015/014148 Invitation to Pay Additional Fees per Additional Invention, 2 pages, dated Mar. 24, 2015.

(Continued)

*Primary Examiner* — Ryan Reis
(74) *Attorney, Agent, or Firm* — Morani Patent Law, PC

(57) ABSTRACT

An automatic stovetop fire suppressor providing a gradual release of a fire suppressing agent in a desired distribution pattern and method of gradual and spatial agent release are provided herein. A plastic cone shaped lid seals on the bottom of a can and forms a closed container. The closed container is filled with a fire suppressing agent. An initiator charge breaks a designed breaking point of a reduced horizontal cross sectional area when fuse activated. The bottom lid drops down exposing a radial opening. Fire suppressing agent flows out of the radial opening, suppressing a stovetop fire with minimal or no splashing of cooking oil. An initiator housing is affixed to a top wall of the can and serves as the welding point for securing the plastic lid. A travel limiting member attached to the bottom lid catches on a shoulder of the initiator housing to limit the radial opening height.

19 Claims, 16 Drawing Sheets

(56) References Cited

U.S. PATENT DOCUMENTS

| | | | | | |
|---|---|---|---|---|---|
| 1,816,892 | A | | 8/1931 | Bronander | |
| 2,025,326 | A | | 12/1935 | Bouillon | |
| 3,040,815 | A | | 6/1962 | Pambello | |
| 3,209,837 | A | | 10/1965 | Freedman | |
| 3,757,866 | A | | 9/1973 | Mears | |
| 3,773,111 | A | * | 11/1973 | Dunn | A62C 3/006 169/26 |
| 3,782,475 | A | | 1/1974 | Schmidt | |
| 3,833,063 | A | * | 9/1974 | Williams | A62C 13/006 169/28 |
| 3,874,458 | A | | 4/1975 | Williams | |
| 3,884,306 | A | * | 5/1975 | Williams | A62C 13/006 169/28 |
| 3,884,307 | A | * | 5/1975 | Williams | A62C 35/10 169/28 |
| 3,897,826 | A | | 8/1975 | Hutchison | |
| 3,918,526 | A | | 11/1975 | Hattori | |
| 4,011,911 | A | | 3/1977 | Gow | |
| 4,023,494 | A | | 5/1977 | Barton | |
| 4,113,020 | A | | 9/1978 | Panetta | |
| 4,256,181 | A | | 3/1981 | Searcy | |
| 4,485,741 | A | | 12/1984 | Moore | |
| 4,813,487 | A | | 3/1989 | Mikulec | |
| 4,964,469 | A | * | 10/1990 | Smith | A62C 3/025 102/488 |
| 5,297,636 | A | | 3/1994 | North | |
| 5,351,760 | A | | 10/1994 | Tabor | |
| 5,375,523 | A | * | 12/1994 | Morris | F42B 4/30 102/202.9 |
| 5,518,075 | A | * | 5/1996 | Williams | A62C 35/08 169/28 |
| 5,628,367 | A | | 5/1997 | Traux et al. | |
| 5,868,205 | A | | 2/1999 | Cunningham et al. | |
| 5,871,057 | A | | 2/1999 | Stehling et al. | |
| 5,881,819 | A | | 3/1999 | Walters et al. | |
| 5,899,278 | A | | 5/1999 | Mikulec | |
| 6,029,751 | A | | 2/2000 | Ford et al. | |
| 6,105,677 | A | * | 8/2000 | Stager | A62C 37/12 169/26 |
| 6,244,353 | B1 | | 6/2001 | Greer | |
| 6,276,461 | B1 | | 8/2001 | Stager | |
| 6,796,382 | B2 | | 9/2004 | Kaimart | |
| 7,182,143 | B2 | | 2/2007 | Hall et al. | |
| 7,472,758 | B1 | * | 1/2009 | Stevens | A62C 35/08 102/322 |
| 7,610,966 | B1 | | 11/2009 | Weintraub et al. | |
| 7,934,564 | B1 | | 5/2011 | Stell et al. | |
| 7,969,296 | B1 | | 6/2011 | Stell | |
| 8,294,567 | B1 | | 10/2012 | Stell | |
| 8,517,117 | B2 | | 8/2013 | Mikulec | |
| 2003/0010506 | A1 | | 1/2003 | Braun | |
| 2008/0087446 | A1 | | 4/2008 | Sitabkhan | |

OTHER PUBLICATIONS

PCT/US2015/014339 Invitation to Pay Additional Fees per Additional Invention, 2 pages, dated Mar. 27, 2015.

* cited by examiner

DISTRIBUTION OF FIRE SUPPRESSING AGENT IN A STOVETOP FIRE SUPPRESSOR AND METHOD

CROSS REFERENCE TO RELATED APPLICATIONS

This application claim priority to U.S. Provisional Application No. 61/943,017, filed 21 Feb. 2014, the entire contents of which are incorporated herein by reference.

FIELD OF THE INVENTION

The present invention relates to a device and method of fire suppression, and more particularly to an automatic stovetop fire suppressor.

BACKGROUND OF THE INVENTION

Stovetop fires are a well-known residential and commercial hazard. An unattended stovetop fire, for example a grease fire, can cause damage to nearby appliances and cabinets. Worse, stovetop fires can lead to structural damage or injury. Because the propensity for stovetop fires is so pervasive, an efficient means of automatic fire suppression is desired. Even if a stovetop fire is attended, an automatic extinguishing method may be more effective and expedient compared to manual means.

A number of conventional automatic stovetop fire extinguishers, which mount above the stovetop surface, are available. These include: U.S. Pat. No. 6,276,461 to Stager; U.S. Pat. No. 6,105,677 to Stager; U.S. Pat. No. 5,899,278 to Mikulec; U.S. Pat. No. 7,472,758 to Stevens and Weintraub; U.S. Pat. No. 7,610,966 to Weintraub et al; U.S. Pat. No. 5,518,075 to Williams; and U.S. Pat. No. 3,884,307 to Williams. The array of conventional fire suppression systems vary from pendulum swing apparatus (Stager '461), to canister systems (Williams '307 and Stager '677), or to tube connecting systems for liquid effluent (Mikulec '278). The array of conventional fire suppression systems vary from activation by melting of a fusible pin (Stager '461), to melting a solder fusible plug (Stager '677), to burning of a fuse (Williams '307, Stevens '758), or to activating via a glass bulb fuse mechanism (Mikulec '278).

In conventional stovetop fire suppressor methods the release of the fire suppressing agent may occur in a single burst.

In a stovetop fire condition, it may be desirable to provide a controlled release of a fire suppressing agent both in a pattern of distribution of the agent and in the release of the agent as a function of time.

SUMMARY OF THE INVENTION

The present invention addresses some of the issues presented above by providing a controlled release of a fire suppressing agent in an automatic stovetop fire suppressor. Aspects of the present invention are provided for summary purposes and are not intended to be all inclusive or exclusive. Embodiments of the present invention may have any of the aspects below.

Conventionally, the fire suppressing agent deploys in a bulk release upon rupture of metal segments. It may be desirable to provide a gradual release of fire suppressing powder or powder-like agent over time. A gradual release over time may enable decreased or eliminated splash of liquid on the stovetop, which may be burning cooking oil.

Further, a broader or directed distribution of the released fire suppressing agent may be desired.

One aspect of the present invention is to provide a user friendly method of suppressing a stovetop fire.

Another aspect of the present invention is to provide an automated release of fire suppressing agent in the presence of a stovetop fire.

Another aspect of the present invention is to provide a flow of fire suppressing agent upon activation of the stovetop fire suppressor.

Another aspect of the present invention is a mounting device and method which affords full and proper function of a stovetop fire suppressor mounted beneath a vent hood.

Another aspect of the present invention is to provide a convenient mounting device for a micro-hood stovetop environment.

Yet another aspect of the present invention is to provide a consistent release of fire suppressing agent upon activation of the stove top fire suppressor.

Another aspect of the present invention is to provide a gradual release of fire suppressing agent over time.

Another aspect of the present invention is to provide a desired distribution pattern of fire suppressing agent in a fire condition.

Another aspect of the present invention is to provide a closed fire extinguishing container in an inactivated state.

Another aspect of the present invention is the ability to use off the shelf parts in the stovetop fire suppressing device.

Yet another aspect of the present invention is to provide stovetop fire suppressor using a combination of ready-made and custom made parts.

Another aspect of the present invention is relative ease of use in employment of the present invention in field applications.

Another aspect of the present invention is a method of using an ultrasonic weld to close the fire suppressor container.

Another aspect of the present invention is using mated threads across the initiator housing and the bottom lid to close the fire suppressor container.

Another aspect of the present invention is a method of releasing the fire suppressing agent upon lowering of the bottom lid.

Another aspect of the present invention is a reduced cross sectional area at the designed breaking point.

Another aspect of the present invention is breakage at the designed breaking point with initiator induced activation pressure or activation forces.

Still another aspect of the present invention is the use of plastic for the bottom lid of the fire suppressor container.

Another aspect of the present invention is the containment of the fire suppressing agent in a closed container from manufactured end to activation of the device in a fire condition.

Still another aspect of the present invention is the use of a fuse for activation of the fire suppressing device.

Another aspect of the present invention is a the use of a reduced charge size, as compared to conventional stovetop fire suppressors, for activation of the fire suppressing device.

Another aspect of the present invention is the ability to vary the distribution pattern of the fire suppressing agent by changing the cone angle of the container bottom lid.

Another aspect of the present invention is the ability to vary the release time of the fire suppressing agent by varying the drop height of the cone lid upon activation.

Another aspect of the present invention is the ability to vary the release time of the fire suppressing agent by varying both the cone angle of the container bottom lid and the drop height of the cone lid upon activation.

Still another aspect of the present invention is the use of thermo-molding to create a custom container bottom lid.

In still another aspect of the present invention, the lid pattern is concave or convex.

In still another aspect of the present invention is the use of mechanical fingers integral to the container bottom lid to limit the drop height of the lid on activation.

Another aspect of the present invention is a catching surface on the initiator housing for the mechanical fingers on the container bottom lid.

Another aspect of the present invention is the use of a ready-made threaded insert to secure the initiator housing to the top of the fire suppressor container and to enable mounting of the fire suppressor above the stovetop.

Another aspect of the present invention is to use a commercially available can in the fire suppressor container assembly.

Another aspect of the present invention is to use a combination of an aluminum can and a plastic bottom lid to form a closed container for a fire suppressing agent.

Another aspect of the present invention is to modify the aluminum can to form a catching surface for the container bottom lid upon activation of the fire suppressor.

Still another aspect of the present invention is the use of a plastic custom initiator housing.

Still another aspect of the present invention is thermo-molding the initiator housing.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Same reference numbers across figures refer to like elements for ease of reference. Reference numbers may also be unique to a respective figure or embodiment.

Figure 1A:
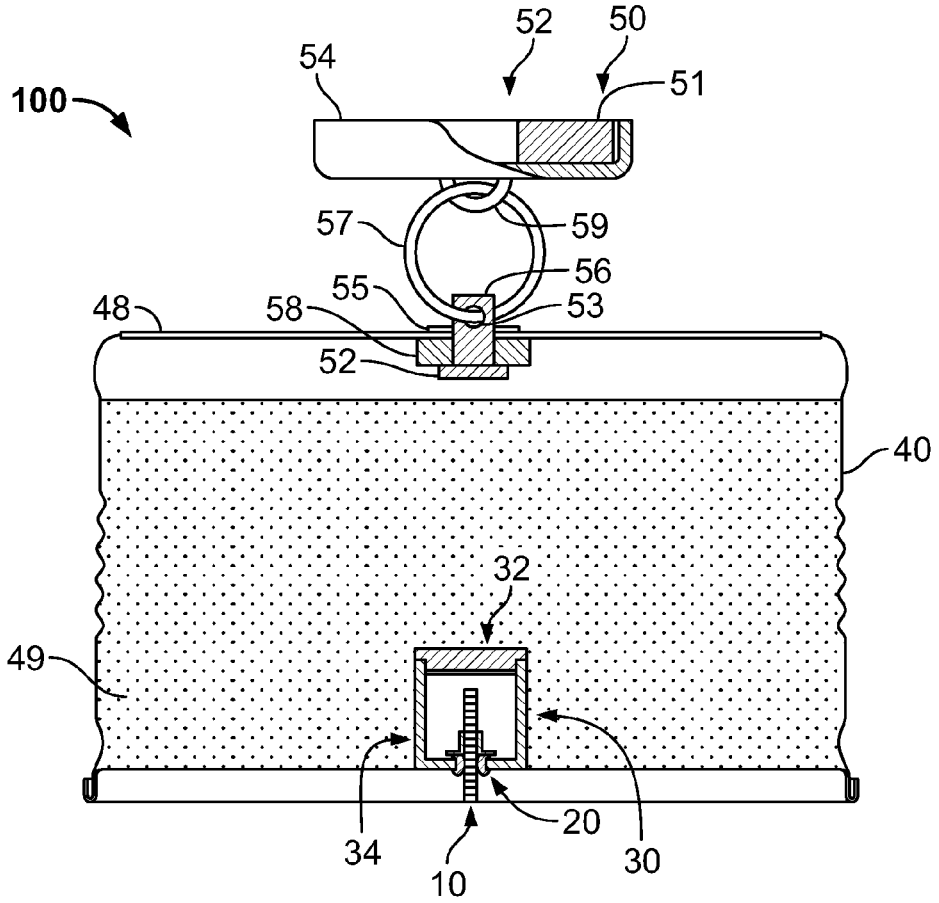
FIG. 1A Prior Art
FIG. 1A shows a partial cross section of a conventional stovetop fire suppressor for mounting under a vent-hood taken through the axial center.

Conventional fire suppressors which are particularly well suited to a stovetop environment include a container of an extinguishing agent and are mounted to a vent hood above the stovetop. An example of such an extinguisher is shown in FIG. 1A. FIG. 1A is a cross sectional view along the center axis of a closed container automatic stovetop fire suppressor. Through the bottom wall or lid 20 of the container 40 extends a fuse 10. A fire on the stovetop ignites the fuse 10, which in turn detonates an initiator 30. The initiator 30 opens the bottom 20 of the container 40, thereby allowing the disbursement of the extinguishing agent 49 onto the fire and the stovetop. The container is secured via a magnet 50 to a hood over the stove.

Figure 2A:
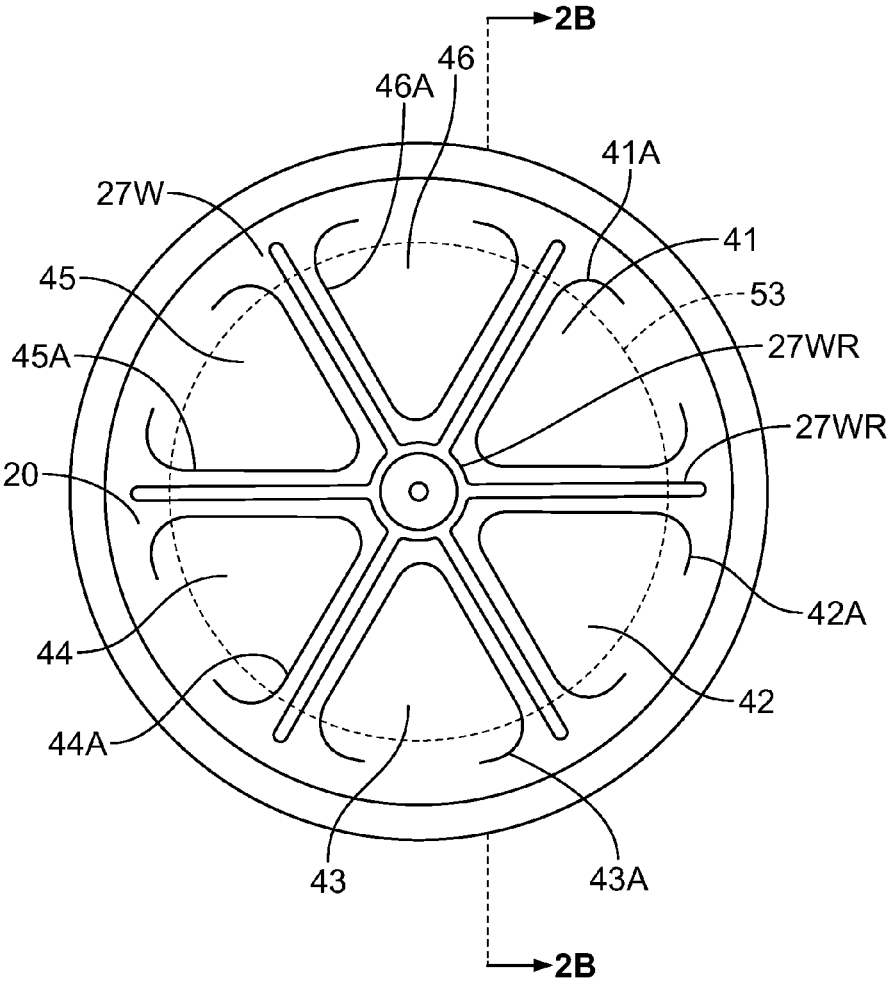
FIG. 2A Prior Art
FIGS. 2A and 2B show a bottom view of an outside of a container lid and cross section of the lid as taken along line 2*b*-2*b*, respectively, in accordance with a conventional stovetop fire suppressor.
Figure 2B:
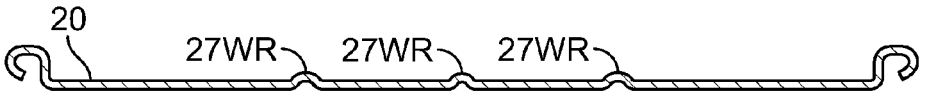
FIG. 2B Prior Art

In a conventional stovetop fire suppressor, the initiator housing 34 is affixed to the bottom lid 20. The fuse 10 extends into the initiator housing 30, wherein an explosive charge is housed, charge not shown. Alternate, matter may be used for or in the initiator charge, such as black powder substitute. Referring now to FIGS. 2A and 2B, a bottom lid 20 of a conventional stovetop fire suppressor is shown in greater detail.

Figure 1B:
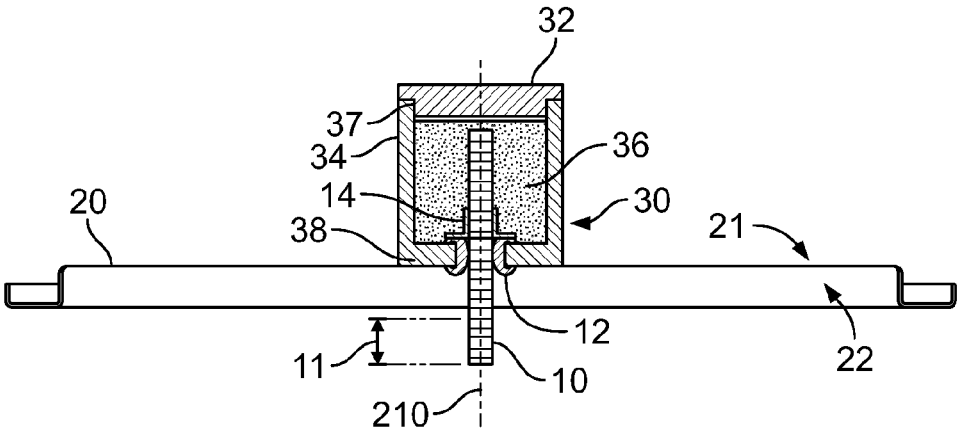
FIG. 1B Prior Art
FIG. 1B shows a partial cross section of a conventional stovetop fire suppressor initiator mounted in a conventional bottom lid taken along the axial center.

FIGS. 2A and 2B show a view of an outside of a container lid 20 and a cross section view of the lid as taken along line 2B-2B, respectively. Once assembled, the fuse extends through the lid 20 exposing its cut end past the outside side of the lid, fuse not shown. Referring to FIG. 2A, the bottom lid 20 has grooves or scored lines 41A-46A selectively formed on the outside thereof to facilitate breaking or rupturing of the bottom end into separate tear-open segments 41-46 without fragmentation to form openings 41B-46B, openings not shown, only in the bottom wall, lid 20, when the free ends of the segments are forced outward to allow the fire extinguishing powder 49, shown in FIG. 1, to fall or pass outward from the container onto the fire. Although the scoring is illustrated on the outside surface of the lid it can be on the inside surface thereof. The fuse 10, shown for example in FIG. 1B, is lit by a stovetop fire which burns into the into initiator 30 and ignites the charge 36. When this occurs, the force of the explosion ruptures the scored or weakened lines and forces the tear open segments 41-46 outward to form the openings 41B-46B. The fire extinguishing powder then falls out of container 40, shown in FIG. 1A, for example, to extinguish any fire below which may be in a frying pan, for example.

Still referring to FIGS. 2A and 2B, the non-erupting portions of the lid 20 is referred to as the web 27W of the lid 20. Embossed reinforcing ribs 27WR are formed in the lid 20 to make the web 27W stiffer and to assist in minimizing any problem of the segments 41-46 or vanes not opening outward. The embossing forms a center circle with radially extending ribs between break open segments 41-46. The ribs 27WR may be formed by bending the web 27W outward after the score lines 41A are formed, which tends to pull metal away from the score lines 41A-46A and may facilitate opening of the segments 41-46.

Figure 3A:
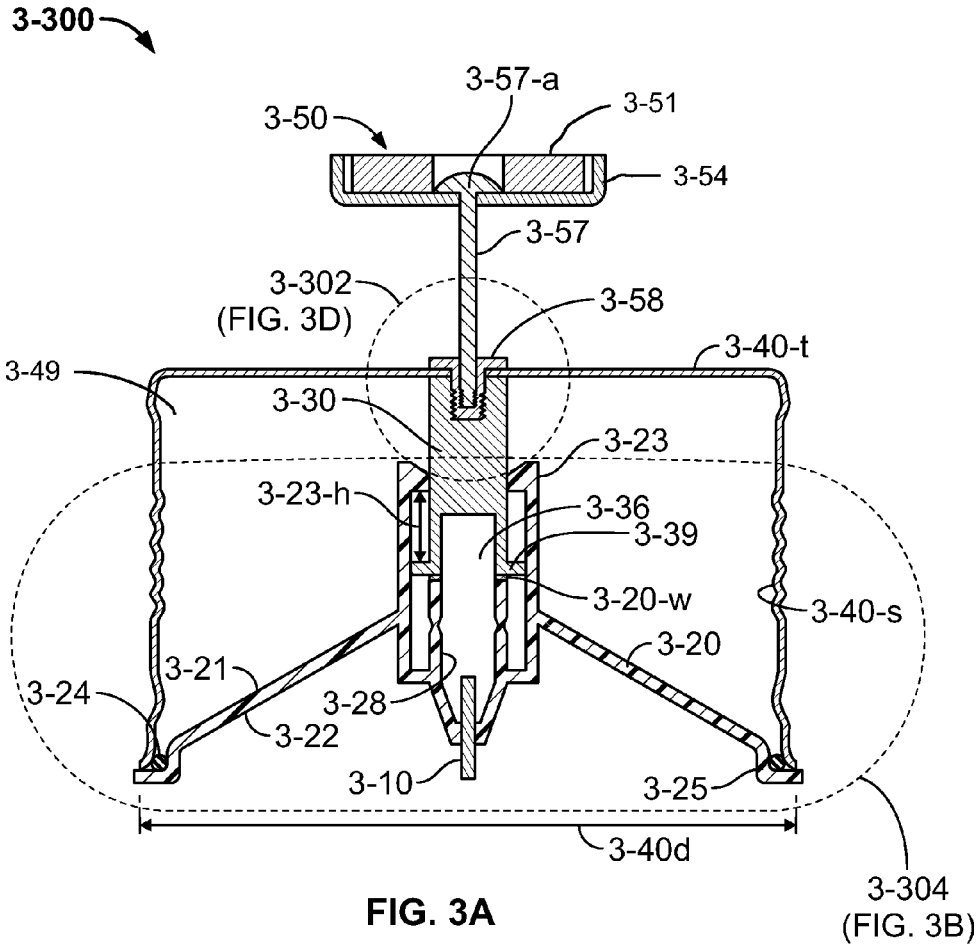
FIG. 3A shows cross section along axial center of an of a stovetop fire suppressor in a closed state having a designed breaking point, in accordance with an exemplary embodiment of the present invention

FIG. 3A shows cross section along axial center of an of a stovetop fire suppressor in a closed state having a designed breaking point of reduced cross sectional area, in accordance with an exemplary embodiment of the present invention. Starting from a mounting for the fire suppressor 3-50, a magnet 3-51 sits in a magnet housing 3-54. The housing 3-54 is connected to a threaded insert 3-58 via a screw 3-57. More particularly the screw head 3-57-*a* rests in the magnet housing 3-54 and the screw shaft extends down wherein screw threads, not shown, mate with internal threads of the threaded insert 3-58. A cross section of the interface across the insert 3-58, initiator 3-30, and a top 3-40-*t* of the can 3-40, 3-302 is shown in greater detail in FIG. 3D. Briefly referring to FIG. 3D, a shoulder 3-58-*sh* of the threaded insert 3-58 is disposed upon an outer side of the top 3-40-*t* of the container 3-40 and the threaded insert 3-58 secures the initiator housing 3-30 to a top 3-40-*t* of the container 3-40. In accordance with the exemplary embodiment of FIG. 3A, the insert 3-58 also secures the container, or can, 3-40 to the mounting assembly 3-50 via a screw 3-57.

Referring again to FIG. 3A, the initiator housing has a cavity for an initiator charge 3-36 and may have shoulders, or a catching surface 3-39. Turning to the cone shaped bottom lid 3-20, travel limit fingers 3-23 may be used to catch a lid 3-20 of an activated device on, for example, a shoulder 3-39 on an initiator housing 3-30. A fuse 3-10 extends from the initiator charge 3-36 past an outer surface, 3-22 shown in FIG. 3B, of the cone shaped bottom lid 3-20. At the outer edge of the lid 3-20 is a groove, a 90 degree angle, or a channel 3-25. A seal 3-24 is seated in the groove 3-25 and seals against an inner side of the container wall 3-40-*s* when the fire suppressor is in its closed and inactivated state, FIG. 3A. In accordance with an exemplary embodiment of the present invention, the seal 3-24 may be a rubber o-ring. The seal 3-24 prevents leakage of the fire suppressing agent but does not withstand initiator 3-30 activation pressure. Housed within the container 3-40 is a fire suppressing agent 3-49. In accordance with an exemplary embodiment, seal 3-24 provides a hermetically sealed container. In accordance with the exemplary embodiment shown in FIG. 3A, the travel limit fingers 3-23 are integral to the cone shaped lid 3-20 and are made of plastic. Likewise, the initiator housing 3-30 is made of plastic with shoulder 3-39 integral to the housing for catching of the travel limit fingers 3-23 upon activation. Both the lid 3-20 and the initiator housing 3-30 may be formed by thermomolding.

Figure 3B:
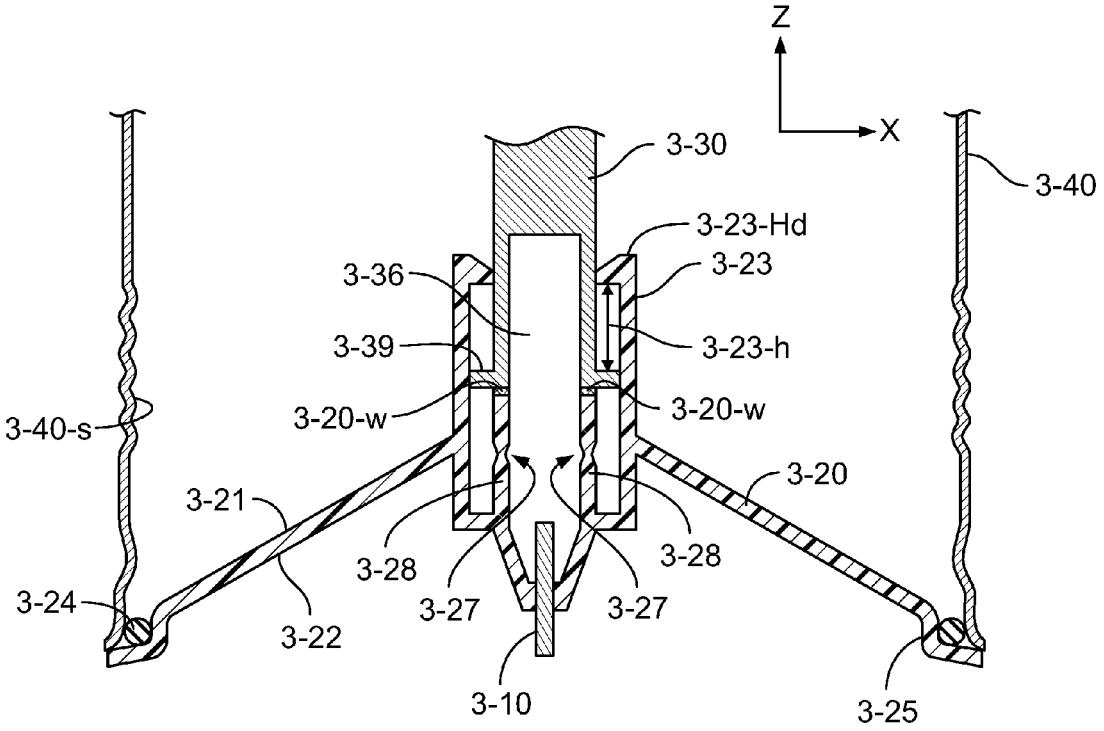
FIG. 3B shows a portion of the cross sectional view in FIG. 3A having a designed breaking point at a decreased cross sectional area, in accordance with an exemplary embodiment of the present invention.

Also shown in FIG. 3A is the ultrasonic weld connection site 3-20-W between attaching branches 3-28 of the lid 3-20 and the initiator housing 3-30. The attaching branches 3-28 and section 3-304 of FIG. 3A is shown in FIG. 3B in more detail. In accordance with the embodiment shown in FIGS. 3A-3C, respective reduced cross sectional areas 3-27 are shown below each weld point in the attaching branches 3-28. Turning to FIG. 3B, these reduced cross sectional areas are designed into the attaching branches 3-28 of the lid 3-20 to provide a desired breaking point. Like the travel limiting members 3-23, the attaching branches 3-28 may be integral to the bottom lid 3-20. In accordance with an exemplary embodiment, the attaching branches 3-28 are rod shaped. In accordance with the exemplary embodiments shown in FIGS. 3A-3C, there are four attaching branches 3-28 at a ninety degree separation between any two adjacent branches. In alternate embodiments, three attaching branches separated by 120 degrees are used. In still other embodiments less than three attaching branches are used or more than four attaching branches are used. During assembly of a stovetop fire suppressor in accordance with an exemplary embodiment of the present invention, the lid 3-20 is ultrasonically welded to the initiator housing 3-30 seating the lid in a closed position, as shown in FIGS. 3A-3B. In accordance with an alternate embodiment, the lid may be affixed to the initiator housing with an adhesive. In accordance with an exemplary embodiment of the present invention, an off the shelf aluminum can serves as the container 3-40 and has a diameter of four inches 3-40-*d*.

Figure 3C:
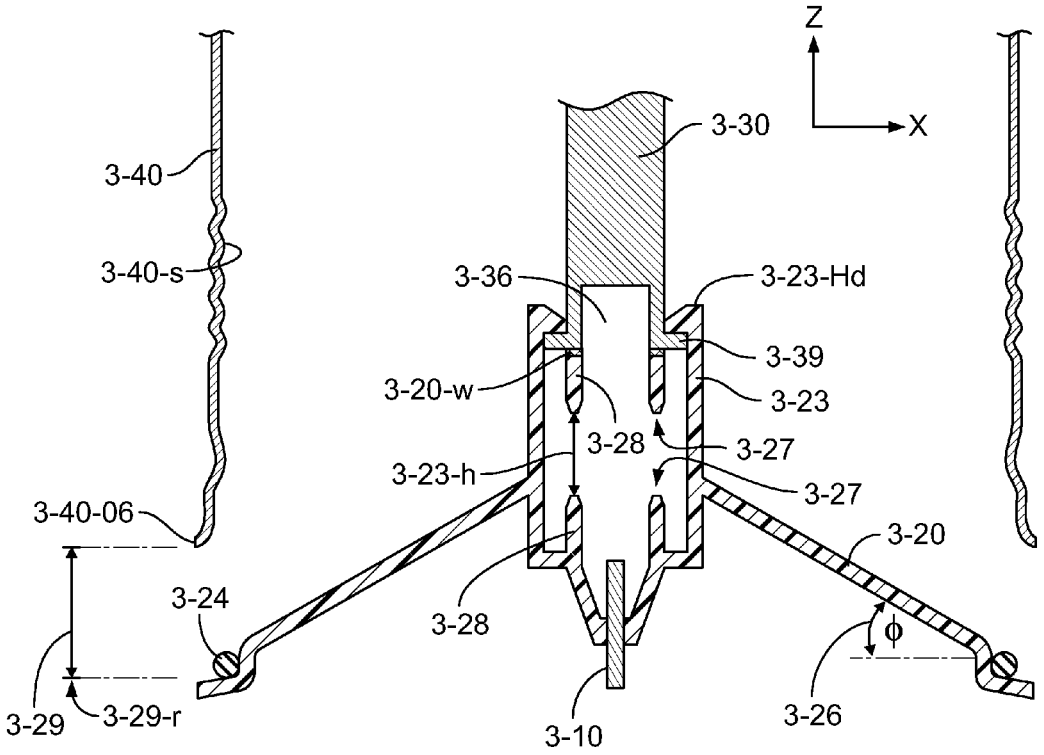
FIG. 3C shows the cross section along axial center of the stovetop fire suppressor of FIG. 3B in an activated state, in accordance with an exemplary embodiment of the present invention.

FIG. 3C shows the cross section along axial center of the stovetop fire suppressor having a designed breaking point of FIG. 3B in an activated state, in accordance with an exemplary embodiment of the present invention. When fire lights the fuse 3-10, the initiator charge ignites and the reduced cross section 3-27 of the attaching branches 3-28 breaks, where the fuse 3-10 in FIG. 3C is shown in its inactivated state for illustrative purposes. Upon breaking of the attaching branch 3-28 at point 3-27 below the weld 3-20-W and above the lid 3-20, the lid 3-20 drops until head 3-23-Hd of the travel limit fingers 3-23 catch on the shoulder 3-39 of the initiator housing 3-30. The seal 3-24 is designed to break away readily as the branches 3-28 break with the activation pressure induced by the initiator charge. As the lid 3-20 drops below the bottom of the container 3-40, a radial opening 3-29*r* is created. The drop height 3-29, the vertical distance between a bottom edge of the side 3-40-*s* of the container 3-40 and the outer edge of the cone lid 3-20, provides the opening for the fire suppressing agent 3-49 to flow out for fire suppression.

This height 3-29 can be modified by, for example, a height 3-23-*h* of the travel limit fingers 3-23. In accordance with an exemplary embodiment of the present invention, the drop height 3-29 is near 0.20 inches. The number of travel limiting fingers can be three or more. Alternate embodiments may comprise alternate height 3-29 limiting and lid 3-20 catching 3-39 configurations. In still alternate embodiments, a modification can be made to the inner side wall 3-40-*s* to catch a travel limiting member 3-23 on the lid.

The cone shaped lid has a cone angle, pheta, 3-26. The angle of the cone influences the flow of the exiting fire suppressing agent. The flow rate and spatial distribution of the suppressing agent 3-49, in accordance with the present invention, may be varied by, for example, the drop height 3-29, the angle 3-26 of the cone 3-20, or any combination of the same. The surface of the cone or the shape of the cone can be modified to alter the flow rate and spatial distribution of the fire suppressing agent. For example, alternate embodiments may include a concave or a convex cone. In alternate embodiments, the surface of the cone may be, for example, rough, smooth, grooved, or ribbed.

The location or attachment point of the ultrasonic weld across the lid 3-20 to the initiator housing 3-30 may also vary across alternate embodiments.

Figure 3D:
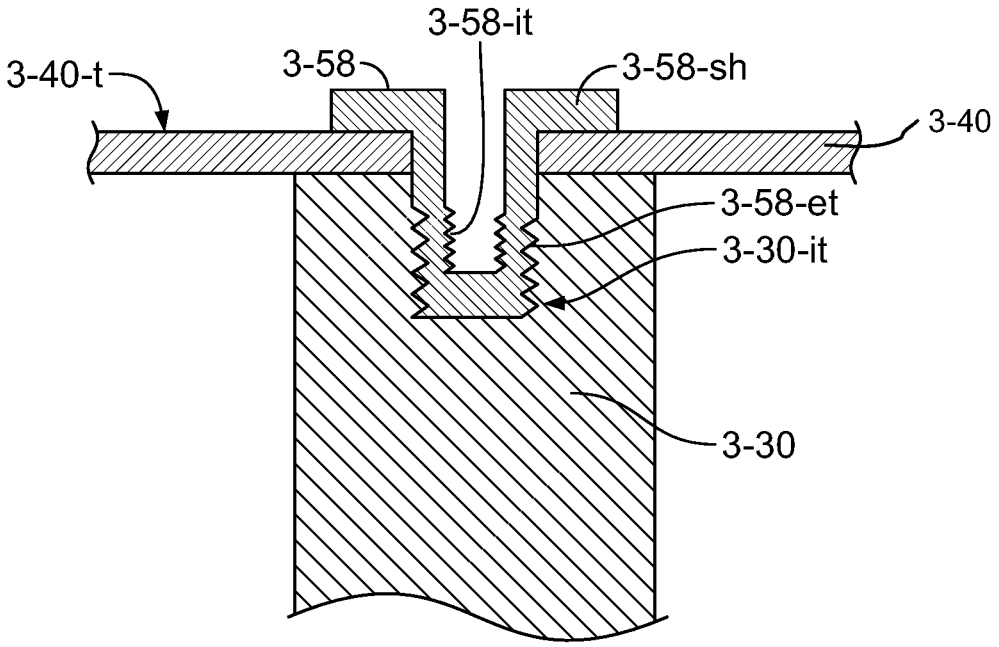
FIG. 3D shows an upper portion of the cross sectional in FIG. 3A in greater detail, in accordance with an exemplary embodiment of the present invention.

FIG. 3D shows a cross section of a top portion 3-302 of an automatic stovetop fire suppressor, in accordance with an exemplary embodiment of the present invention shown in FIG. 3A. Referring again to FIG. 3D, threaded insert 3-58 passes through a top hole in the top wall 3-40-*t* of the can 3-40. The threaded insert 3-58 has a machined shoulder 3-58-*sh* which remains on the outer side of the top wall 3-40-*t* of the can. In accordance with the exemplary embodiment shown in FIG. 3D, internal threads in 3-30-*it* in the initiator housing 3-30 mate with external threads 3-58-*et* on the insert. The threaded insert 3-58 secures the initiator housing 3-30 to the top of the can and sandwiches the top wall 3-40-*t* between shoulders 3-58-*sh* and a top of the initiator 3-30. In accordance with an exemplary embodiment, the insert 3-58 is commercially available. Also in accordance with an exemplary embodiment, the threaded insert 3-58 may also have internal threads 3-58-*it* for mating to a screw 3-57, shown for example in FIG. 3A. The screw may form part of a mounting assembly for a vent hood stovetop environment. In still alternate embodiments, internal threads of the threaded insert may mate to a custom pin for mounting in a micro-hood environment.

Figure 3E:
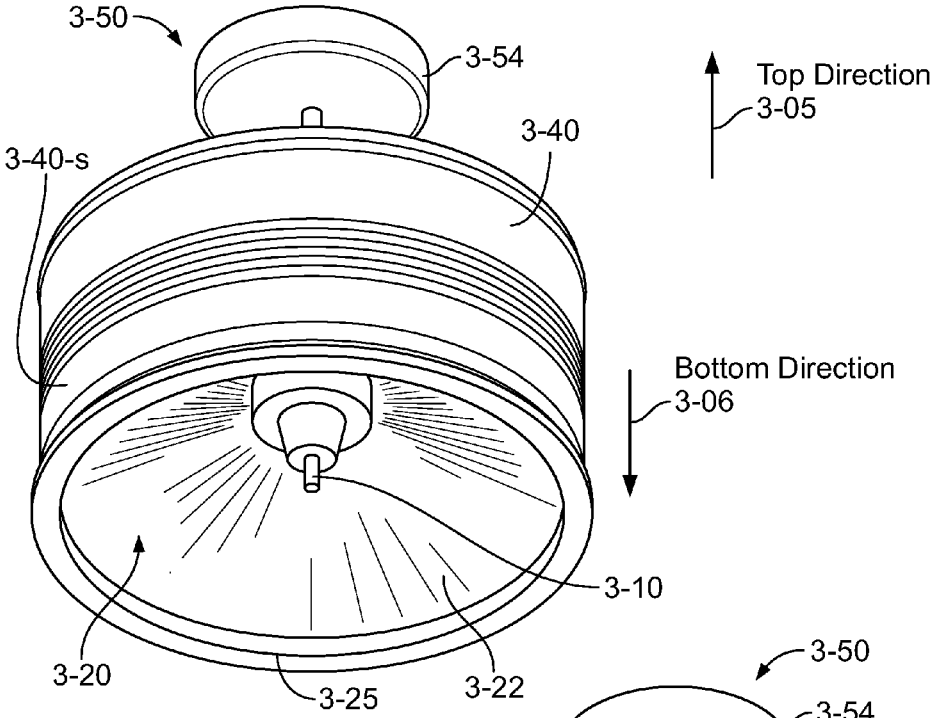
FIG. 3E shows a bottom perspective of an automatic stovetop fire suppressor in a closed state, in accordance with an exemplary embodiment of the present invention.

FIG. 3E shows a bottom perspective of an automatic stovetop fire suppressor in a closed state, in accordance with an exemplary embodiment of the present invention. A mounting assembly 3-50 is shown at a top 3-05 of the figure with a magnet housing 3-54 also shown. In accordance with the exemplary embodiment of FIG. 3D, a magnet within housing 3-54 readily and easily secures the automatic stovetop fire suppressor to a vent hood above the stove surface. A fuse 3-10 extends from an inner housed initiator charge, not shown, past an outer surface 3-22 of the cone shaped bottom lid 3-20. At the outer edge of the lid 3-20 is the circumferential channel 3-25. The cylindrical side wall 3-40-*s* of the container 3-40 is shown, where a bottom 3-06 of the cylindrical side wall 3-40-*s* seals to the outer channel 3-25 of the cone shaped bottom lid 3-20.

Figure 3F:
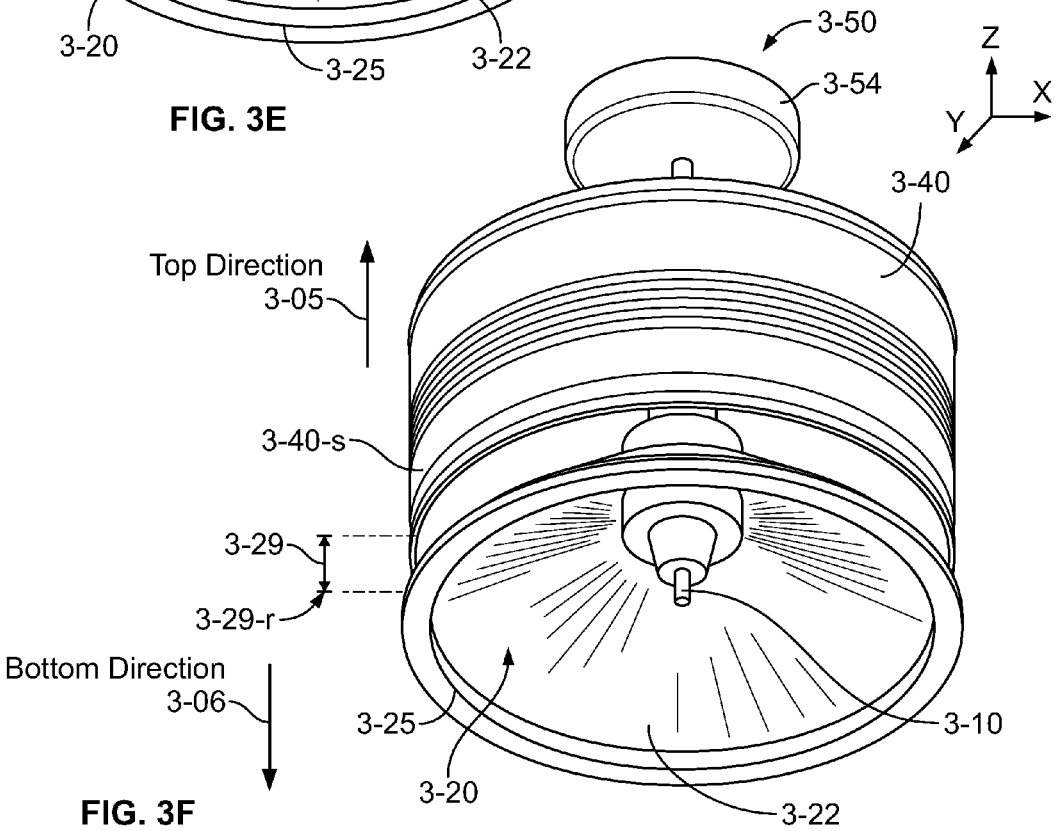
FIG. 3F shows a bottom perspective of an automatic stovetop fire suppressor in an activated state, in accordance with an exemplary embodiment of the present invention.

FIG. 3F shows a bottom perspective of an automatic stovetop fire suppressor in an activated state, in accordance with an exemplary embodiment of the present invention. Although the fire suppressor is shown in an activated state, the fuse 3-10 is shown in its inactivated state for illustration. Upon activation of the automatic stovetop fire suppressor the cone shaped bottom lid 3-20 drops below a bottom 3-06 edge of the side wall 8-40-*s* creating a radial opening 3-29*r*. The limit of the drop height 3-29 is further described above with reference to FIGS. 3A and 3B. In practice, the mounting assembly 3-50 remains secured above the stovetop surface to for, example, a vent hood. In accordance with an exemplary embodiment, a magnet, not shown, housed in a magnet housing 3-54 provides the mounting connection of the stovetop fire suppressor to the vent hood. In accordance with embodiments of the present invention, mounting devices may afford pivoting of the stovetop fire suppressor such that the bottom lid hangs parallel to the horizontal cooking surface even when the mounting surface is tilted to the horizontal. An example of such a mounting device is shown, for example, in FIG. 1A. Referring again to FIG. 3F, the circumferential channel 3-25 is shown displaced from a bottom 8-06 edge of the cylindrical side wall 3-40-*s* by a drop height of 3-29. In accordance with an exemplary embodiment the drop height is greater than 0.20 inches. In accordance with another exemplary embodiment, the drop height is travel limited to 0.20 inches. In another embodiment, an inner surface, not shown, of the bottom lid 3-20 is textured.

Figure 4A:
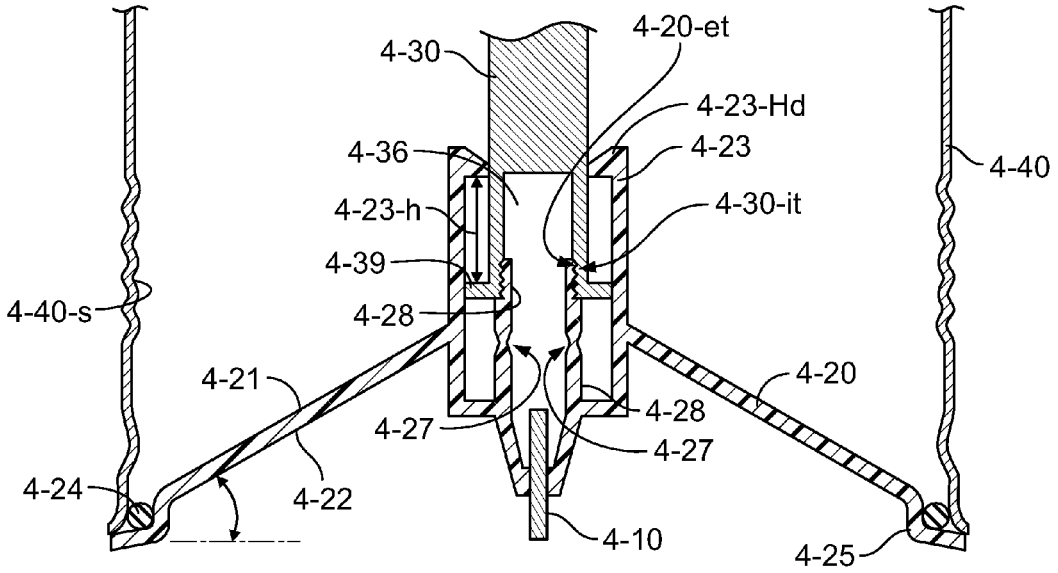
FIG. 4A shows a partial cross section along axial center of an of a stovetop fire suppressor in a closed state using a threaded connection, in accordance with an exemplary embodiment of the present invention.

FIG. 4A shows a partial cross section along axial center of a stovetop fire suppressor in a closed state having a designed breaking point and using a threaded connection across the interface between the bottom lid and the initiator housing, in accordance with an exemplary embodiment of the present invention. The initiator housing 4-30 has a cavity for an initiator charge 4-36 and may have shoulders, or a catching surface 4-39. Turning to the cone shaped bottom lid 4-20, travel limit fingers 4-23 are shown. Heads 4-23-Hd of travel limit members 4-23 catch lid 4-20 of an activated device on, for example, a shoulder 4-39 on an initiator housing 4-30. A fuse 4-10 extends from the initiator charge 4-36 past an outer surface 4-22 of the cone shaped bottom lid 4-20. At the outer edge of the lid 4-20 is a groove, or 90 degree angle, or channel 4-25. A seal 4-24 is seated in the groove 4-25 and seals against an inner side of the container wall 4-40-*s* when the fire suppressor is in its closed and inactivated state, FIG. 4A. In accordance with an exemplary embodiment of the present invention, the seal 4-24 may be a rubber o-ring. The seal 4-24 prevents leakage of the fire suppressing agent but does not withstand initiator 4-30 activation pressure. Housed within the container 4-40 is a fire suppressing agent 4-49. In the embodiment shown in FIGS. 4A-4B, the travel limit fingers 4-23 are integral to the cone shaped lid 4-20 and are made of plastic. Likewise, the initiator housing 4-30 is made of plastic with shoulder 4-39 integral to the housing for catching of the travel limit fingers 4-23 upon activation. Both the lid 4-20 and the initiator housing 4-30 may be formed by thermo-molding.

Also shown in FIG. 4A is the threaded connection between attaching cylinder 4-28 of the lid 4-20 and the initiator housing 4-30. Internal threads 4-30-*it* of the initiator housing 4-30 mate with external threads 4-20-*et* on the attaching cylinder 4-28. The mated threads form the connection between the initiator housing 4-30 and the bottom lid 4-20. In accordance with the exemplary embodiment shown in FIGS. 4A and 4B, a reduced cross sectional area 4-27 is shown below the threaded connection in the attaching cylinder 4-28. Similar to the reduced cross sectional area 3-27 of attaching branches 3-28 in FIGS. 3A-3C, this reduced cross sectional area 4-27 is designed into the attaching cylinder 4-28 of lid 4-20 to provide a desired breaking point. Like the travel limiting members 4-23, the attaching cylinder 4-28 may be integral to the bottom lid 4-20. The reduced cross sectional area 4-27 may be designed into a thermo-mold of the lid 4-20 or may be created, for example, by cutting, notching, or scoring the cylinder 4-28. During assembly of a stovetop fire suppressor in accordance with an exemplary embodiment of the present invention, the lid 4-20 is screwed into the initiator housing 4-30 seating the lid 4-20 in a closed position, as shown in FIG. 4A. In accordance with an exemplary embodiment of the present invention, an off the shelf aluminum can serves as the container 4-40 and has a diameter of four inches.

Figure 4B:
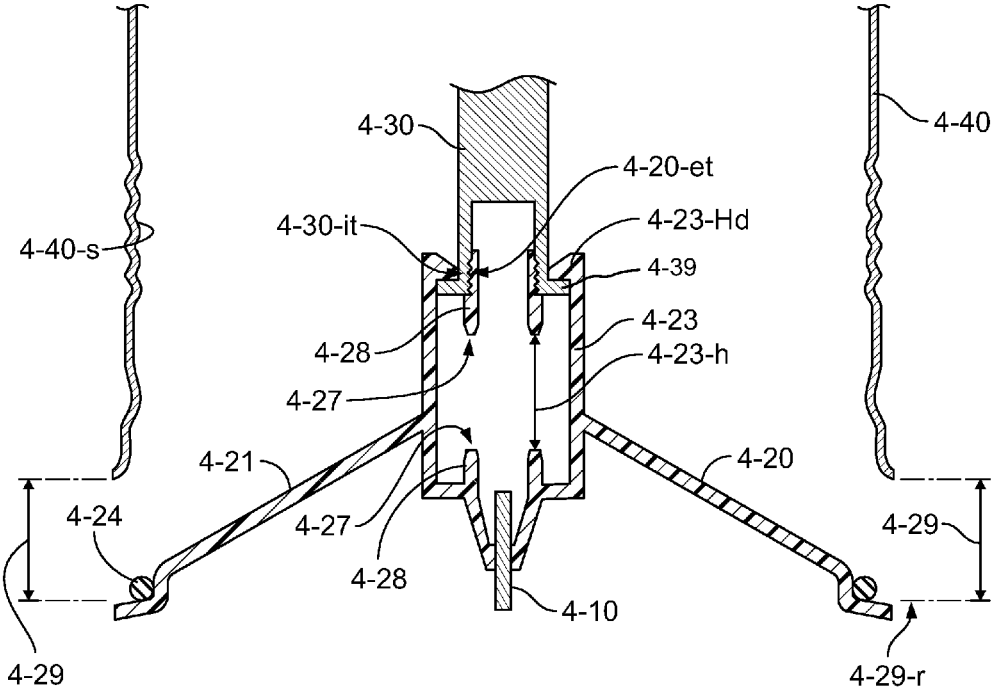
FIG. 4B shows the partial cross section along axial center of the stovetop fire suppressor using a threaded connection in FIG. 4A in an activated state, in accordance with an exemplary embodiment of the present invention.

FIG. 4B shows the partial cross section along axial center of the stovetop fire suppressor using a threaded connection in FIG. 4A in an activated state, in accordance with an exemplary embodiment of the present invention. When fire lights the fuse 3-10, the initiator charge ignites, and the reduced cross section 4-27 of the attaching cylinder 4-28 breaks. Fuse 3-10 in FIG. 4B is shown in its inactivated state for illustrative purposes. Upon breaking of the attaching cylinder 4-28 at point 4-27 below the threaded connection to the initiator housing 4-30 and above the lid 4-20, the lid 4-20 drops until the travel limit heads 4-23-Hd catch on the shoulder 4-39 of the initiator housing 4-30. The seal 4-24 is designed to break away readily as the attaching cylinder 4-28 breaks at 4-27 point with the activation pressure induced by the initiator charge. As the lid 4-20 drops below the bottom of the container 4-40, a radial opening 4-29*r* is created. The drop height 4-29, the vertical distance between a bottom edge of the side 4-40-*s* of the container 4-40 and the outer edge of the cone lid 4-20, provides the opening for the fire suppressing agent 4-49 to flow out for fire suppression.

Figure 5:
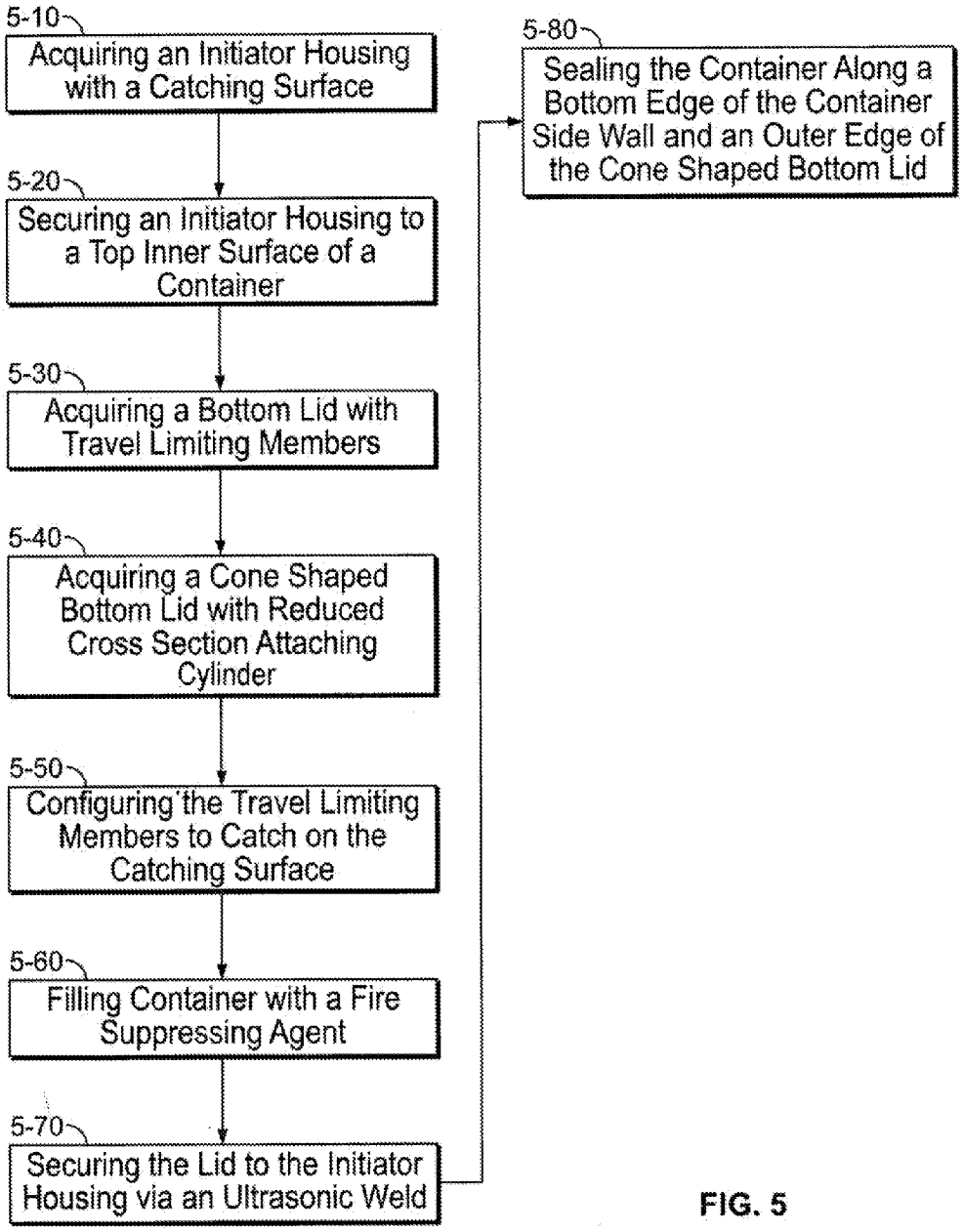
FIG. 5 shows an exemplary method of assembling a fire suppressing agent in an automatic stovetop fire suppressor, in accordance with the present invention.

FIG. 5 shows an exemplary method of assembling an automatic stovetop fire suppressor, in accordance with the present invention. A method of assembling an automatic stovetop fire suppressor, in accordance with an exemplary embodiment includes: acquiring an initiator housing with a catching surface 5-10; securing an initiator housing to a top inner surface of a container 5-20; acquiring a bottom lid with travel limiting members 5-30; acquiring a cone shaped bottom lid with a reduced cross section portion in attaching branches 5-40; configuring the travel limiting members to catch on the catching surface 5-50; filling container with a fire suppressing agent 5-60; securing the lid to the initiator housing via an ultrasonic weld 5-70; and sealing the container along a bottom edge of the container side wall and an outer edge of the cone shaped bottom lid 5-80. In accordance with an exemplary method embodiment, the travel limiting members are integral to the cone shaped bottom lid, and the same is acquired in a single lid. In yet other embodiments, the cone lid has a concave or convex surface. In still other method embodiments, ribs are disposed on side of the cone shaped lid which faces the inside of the container, and such is acquired and sealed to the bottom of the container. In one exemplary embodiment, sealing the lid into the container may take place before and as a separate step from the ultrasonic welding. In still other embodiments, securing the lid to the initiator housing 5-70 may be via an adhesive. In still other embodiments, securing the lid to the initiator housing 5-70 may be by mating threads across an initiator housing and an attaching member or cylinder of the lid. In an exemplary embodiment, the attaching branches, member, or cylinder may be integral to the lid and formed by thermo-molding.

Figure 6:
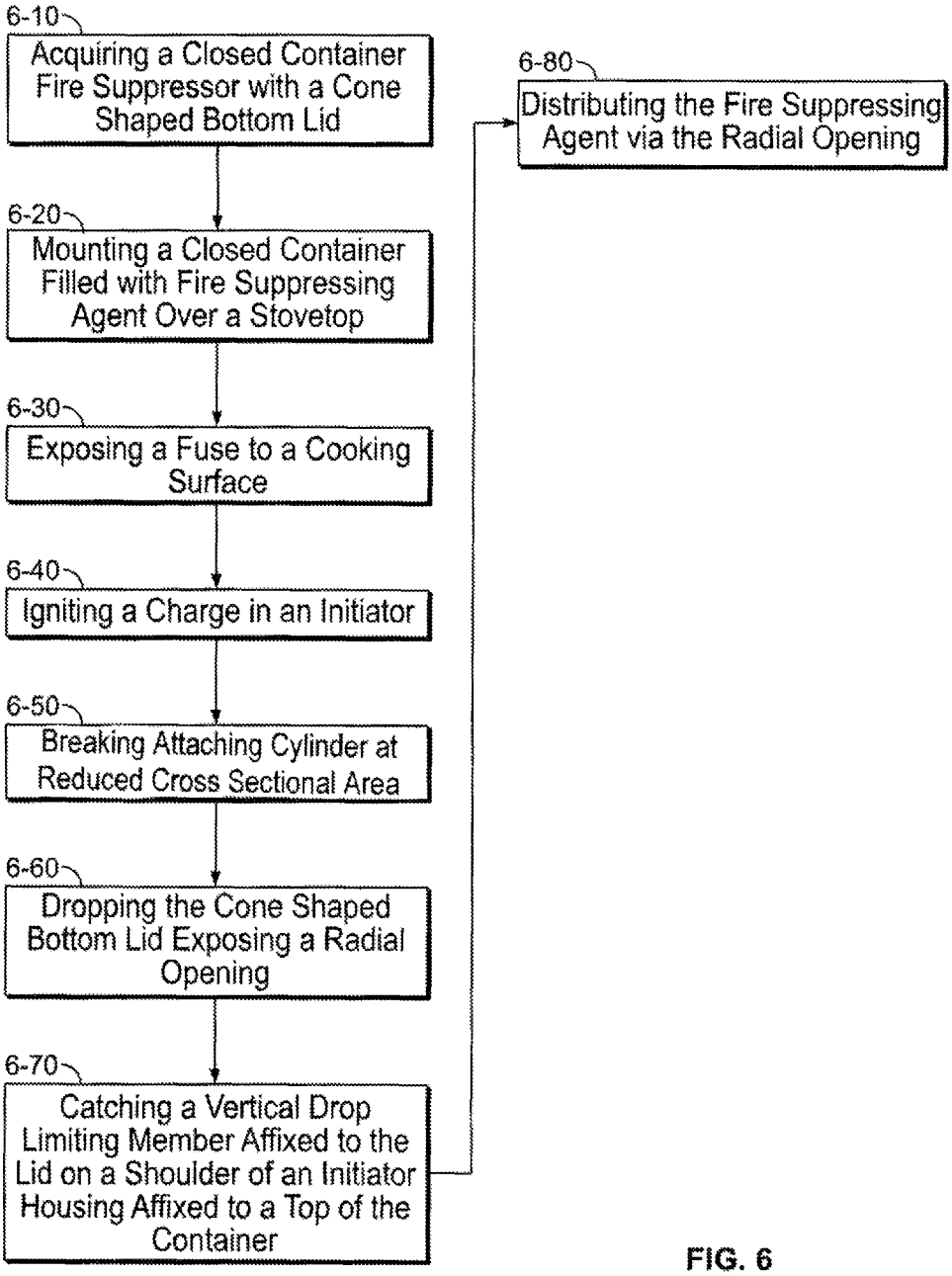
FIG. 6 shows an exemplary method of distributing a fire suppressing agent in an automatic stovetop fire suppressor, in accordance with the present invention.

FIG. 6 shows an exemplary method of distributing a fire suppressing agent in an automatic stovetop fire suppressor, in accordance with the present invention. A method of distributing a fire suppressing agent, in accordance with an exemplary embodiment includes: acquiring a closed container fire suppressor with cone shaped bottom lid 6-10; mounting the closed container filled with fire suppressing agent over a stovetop 6-20; exposing a fuse to a cooking surface 6-30; igniting a charge in an initiator 6-40; breaking attaching branches at respective reduced cross section areas 6-50; dropping the cone shaped bottom lid exposing a radial opening 6-60; catching a vertical drop limiting member affixed to the lid on a shoulder of an initiator housing affixed to a top of the container 6-70; and distributing the fire suppressing agent via the radial opening 6-80.

Figure 7:
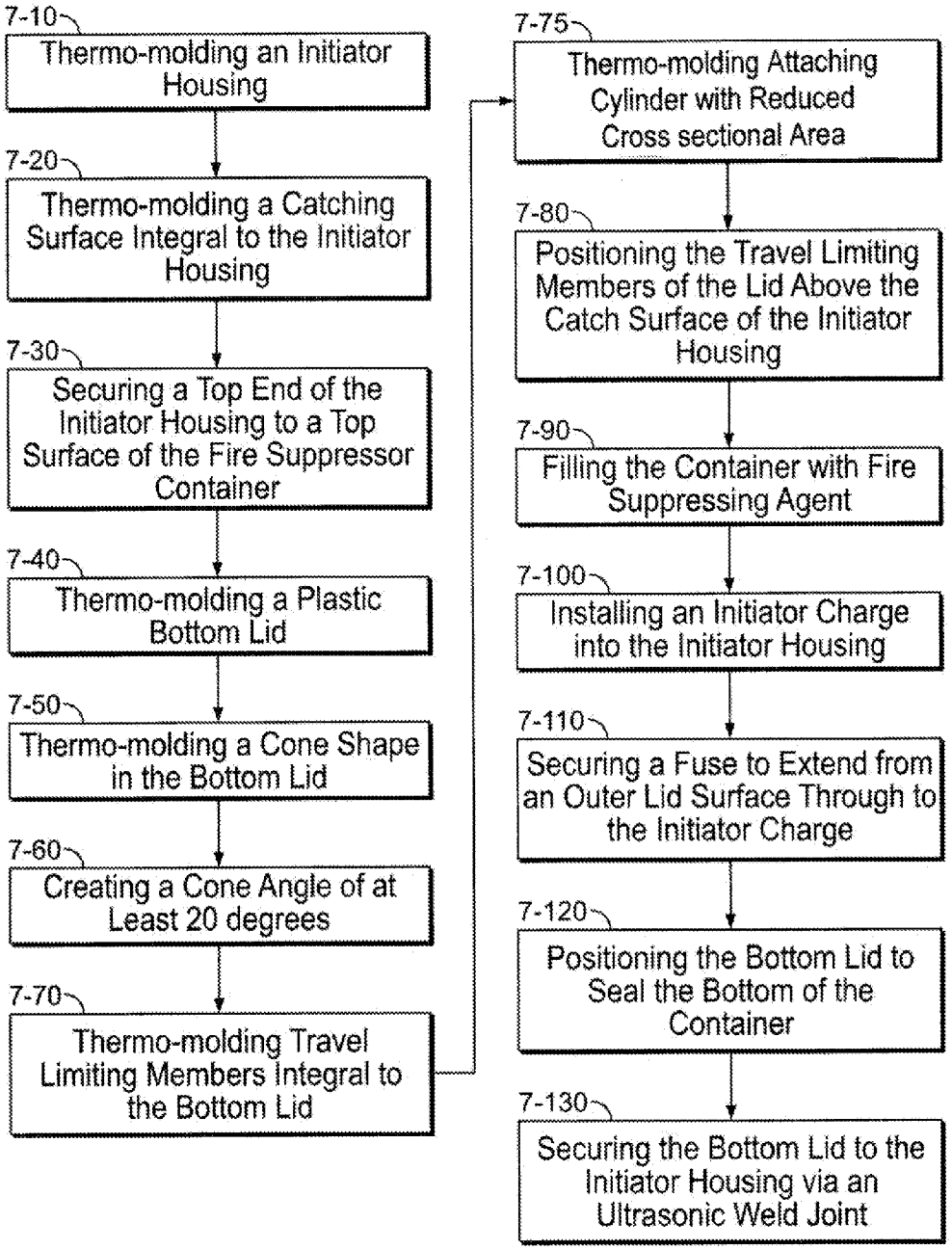
FIG. 7 shows an exemplary method of manufacturing an automatic stovetop fire suppressor, in accordance with the present invention.

FIG. 7 shows an exemplary method of manufacturing an automatic stovetop fire suppressor, in accordance with the present invention. The manufacturing method includes: thermo-molding an initiator housing 7-10; thermo-molding a catching surface integral to the initiator housing 6-20; securing a top end of the initiator housing to a top surface of the fire suppressor container 7-30; thermo-molding a plastic bottom lid 7-40; thermo-molding a cone shape in the bottom lid 7-50; creating a cone angle of at least 20 degrees 7-60; thermo-molding travel limiting members integral to the bottom lid 7-70; thermo-molding attaching members with reduced cross section along the length of the attaching member in the horizontal plane 7-75; positioning the travel limiting members of the lid above the catch surface of the initiator housing 7-80; filling the container with fire suppressing agent 7-90; installing an initiator charge into the initiator housing 7-100; securing a fuse to extend from an outer lid surface through to the initiator charge 7-110; positioning the bottom lid to seal the bottom of the container 7-120; and securing the bottom lid to the initiator housing via an ultrasonic weld joint 7-130. In an alternate embodiment, the bottom lid is secured to the initiator housing via mating threads across the initiator housing and an attaching cylinder that is integral to the lid.

In alternate embodiments, other travel limiting configurations may be employed. For example, a vertical slot or perhaps three vertical slots may be disposed in the initiator housing with a corresponding pin or pins integral to or attached to the bottom lid. In still alternate embodiments, a catching surface may be secured to an inner side wall of the container. The cone angle can, as measured from a bottom horizontal and as shown for example in FIG. 3C, may also vary across embodiments. The angle may vary with the diameter of the container, shown for example in FIG. 3A. The angle may also vary in accordance with a height of the container side wall, where the side wall 3-40-*s* is shown in FIG. 3A.

In accordance with an exemplary embodiment of the present invention, a container diameter of four inches and a cone angle of 45 degrees has yielded a fire suppressing agent distribution rate and pattern which extinguishes a burning cooking oil fire with minimal or no oil splatter. Embodiments of the present invention may be mounted in a micro-hood or vent hood stovetop environment. The weight and volume of fire suppressing agent contained in the container of embodiments of the present invention may be very near that of conventional automatic stovetop fire suppressors. The initiator charge, in accordance with embodiments of the present invention, has a lower activation load as compared with conventional stovetop fire suppressors which separate scored segments in a metal bottom lid. Upon activation of an initiator charge, in accordance with embodiments of the present invention, the designed breaking point in the attaching member breaks and a seal across the circumference of the bottom lid and a bottom edge of the container sidewall breaks.

The present invention utilizes both custom made parts and off the shelf parts reducing supply costs as compared to a fully customized composition. The design in accordance with embodiments of the present invention can be automated for greater efficiency of time and labor and can provide desired throughput. In accordance with embodiments of the present invention, the mounting housing is attached at the factory, eliminating any assembly by the end user.

Figure 8A:
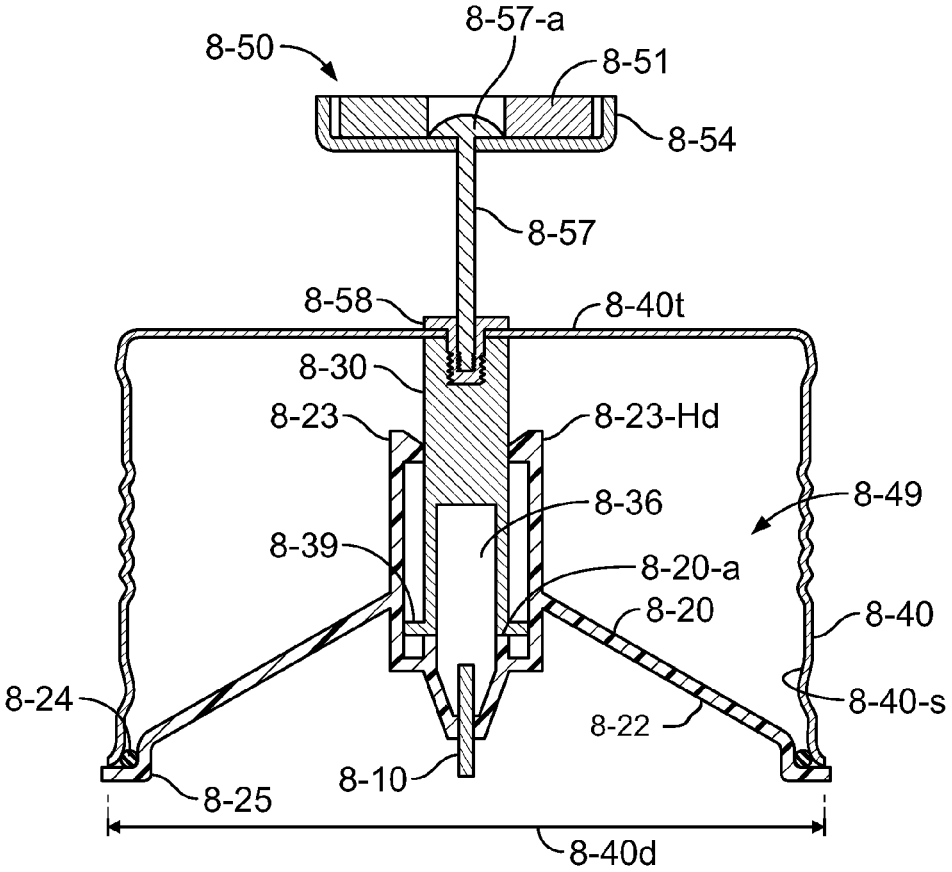
FIG. 8A shows cross section along axial center of a stovetop fire suppressor in a closed state using a break away connection, in accordance with another exemplary embodiment of the present invention.

Referring to FIG. 8A, in accordance with another exemplary embodiment and as in FIG. 3A, the initiator housing has a cavity for an initiator charge 8-36 and may have shoulders, or a catching surface, 8-39 Turning to the cone shaped bottom lid 8-20, travel limit fingers 8-23 may be used to catch a lid 8-20 of an activated device on, for example, a shoulder 8-39 on an initiator housing 8-30. A fuse 8-10 extends from the initiator charge 8-36 past an outer surface 8-22 shown in FIG. 8A of the cone shaped bottom lid 8-20. At the outer edge of the lid 8-20 is a groove, or 90 degree angle, or channel 8-25. A seal 8-24 is seated in the groove 8-25 and seals against an inner side of the container wall 8-40-*s* when the fire suppressor is in its closed and inactivated state, FIG. 8A. In accordance with an exemplary embodiment of the present invention, the seal 8-24 may be a rubber o-ring. Housed within the container 8-40 is a fire suppressing agent 8-49. In accordance with the exemplary embodiment shown in FIG. 8A, the travel limit fingers 8-23 are integral to the cone shaped lid 8-20 and are made of plastic. Likewise, the initiator housing 8-30 is made of plastic with shoulder 8-39 integral to the housing for catching of the travel limit head 8-23-Hd upon activation. Both the lid 8-20 and the initiator housing 8-30 may be formed by thermo-molding.

In accordance with the exemplary embodiment of FIGS. 8A-8D, the attachment point of 8-20-*a* between the lid 8-20 structure and the initiator 8-30 is a break away connection that may be adhesive or alternate fixation that will break under the initiator charge 8-36 induced pressure. During assembly of a stovetop fire suppressor in accordance with an exemplary embodiment of the present invention, the lid 8-20 is secured, for example by adhesive or weak ultrasonic-weld to the initiator housing 8-30 seating the lid in a closed position, as shown in FIG. 8A. In accordance with an exemplary embodiment of the present invention, an off the shelf aluminum can serves as the container 8-40 and has a diameter 8-40-*d* of four inches.

Figure 8B:
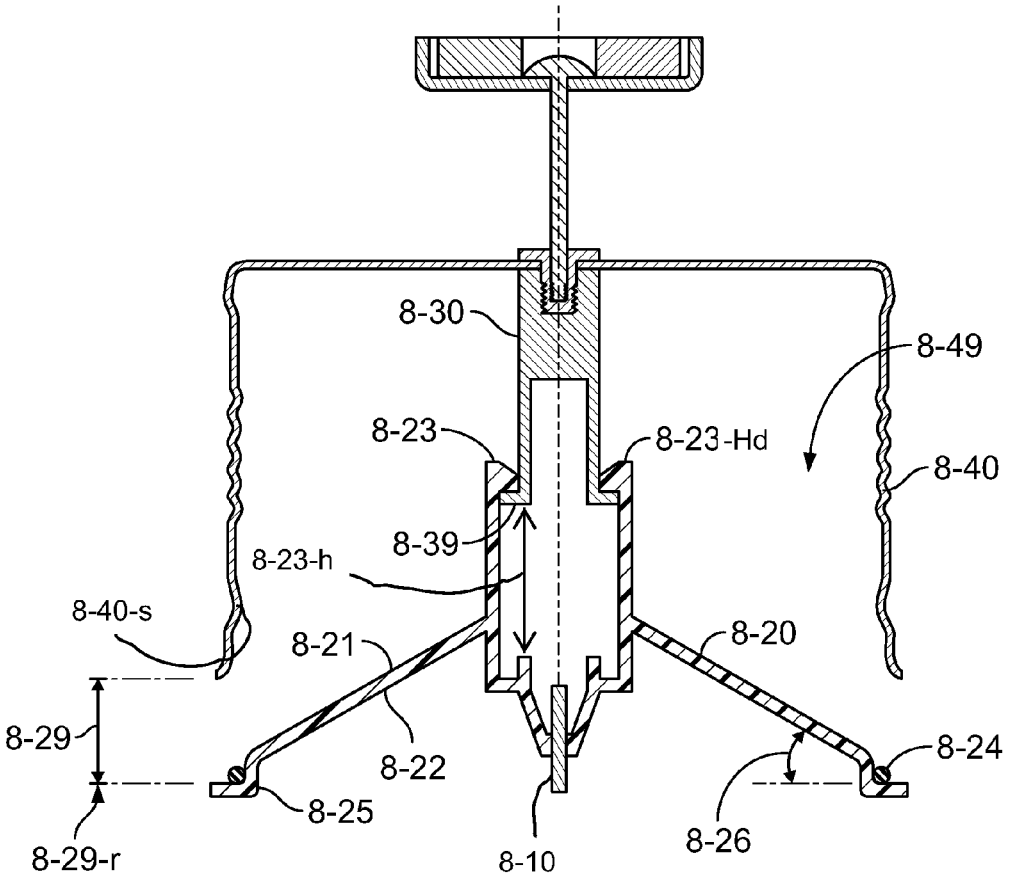
FIG. 8B shows cross section along axial center of an of a stovetop fire suppressor in an activated state using a break away connection, in accordance with another exemplary embodiment of the present invention.

FIG. 8B shows a cross section along axial center of the stovetop fire suppressor of FIG. 8A in an activated state, in accordance with an exemplary embodiment of the present invention. When fire lights the fuse 8-10, the initiator charge ignites and the attachment point 8-20-*a* breaks. Fuse 8-10 in FIG. 8B is shown in its inactivated state for illustrative purposes. Upon breaking of the attachment 8-20-*a* between the lid 8-20 and the initiator 8-30, the lid 8-20 drops until the travel limit fingers 8-23 catch at the finger head on the shoulder 8-39 of the initiator housing 8-30. As the lid 8-20 drops below the bottom of the container 8-40, a radial opening 8-29*r* is created. The drop height 8-29, the vertical distance between a bottom edge of the side 8-40-*s* of the container 8-40 and the outer edge of the cone lid 8-20, provides the opening for the fire suppressing agent 8-49 to flow out for fire suppression.

This height 8-29 can be modified by, for example, a height 8-23-*h* of the travel limit fingers 8-23. In accordance with an exemplary embodiment of the present invention, the drop height is near 0.20 inches. The number of travel limiting fingers can be three or more. Alternate embodiments may comprise alternate height 8-29 limiting and lid 8-20 catching mechanisms 8-39. In still alternate embodiments, a modification can be made to the inner side wall 8-40-*s* to catch a limiting member on the lid. Still other embodiments may include one of more slots in the initiator housing and corresponding one or more pins affixed to or integral to the cone lid 8-20.

The cone shaped lid has a cone angle, pheta, 8-26. The angle of the cone influences the flow of the exiting fire suppressing agent. The flow rate and spatial distribution of the suppressing agent 8-49, in accordance with the present invention, may be varied by, for example, the drop height 8-29, the angle 8-26 of the cone 8-20, or any combination of the same. The surface of the cone or the shape of the cone can be modified to alter the flow rate and spatial distribution of the fire suppressing agent. For example, alternate embodiments may include a concave or a convex cone. In alternate embodiments, the surface of the cone may be, for example, rough, smooth, grooved, or ribbed.

The location or attachment point across the lid 8-20 to the initiator housing 8-30 may also vary across alternate embodiments.

Figure 8C:
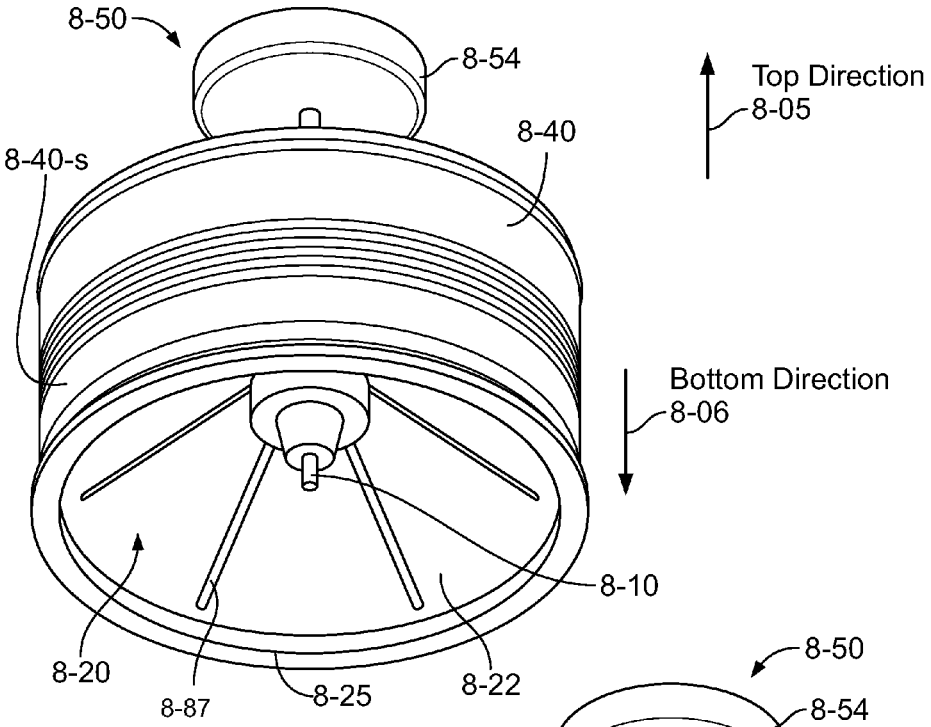
FIG. 8C shows a bottom perspective of an automatic stovetop fire suppressor in a closed state with ribs, in accordance with an exemplary embodiment of the present invention.

FIG. 8C shows a bottom perspective of an automatic stovetop fire suppressor in a closed state, in accordance with an exemplary embodiment of the present invention. A mounting assembly 8-50 is shown at a top 8-05 of the figure with a magnet housing 8-54 also shown. In accordance with the exemplary embodiment of FIG. 8C, a magnet within housing 8-54 readily and easily secures the automatic stovetop fire suppressor to a vent hood above the stove surface. A fuse 8-10 extends from an inner housed initiator charge, not shown, past an outer surface 8-22 of the cone shaped bottom lid 8-20. At the outer edge of the lid 8-20 is the circumferential channel 8-25. The cylindrical side wall 8-40-*s* of the container 8-40 is shown, where a bottom 8-06 of the cylindrical side wall 8-40-*s* seals to the outer channel 8-25 of the cone shaped bottom lid 8-20. Also shown, in accordance with yet another embodiment, are indents 8-87 in the bottom lid. These indents may have a raised surface on an inner side of the lid 8-20 and a depression in outer surface 8-22 of the lid 8-20. When fire lights the fuse 8-10, the initiator charge ignites and the fixation at the attachment point breaks.

Figure 8D:
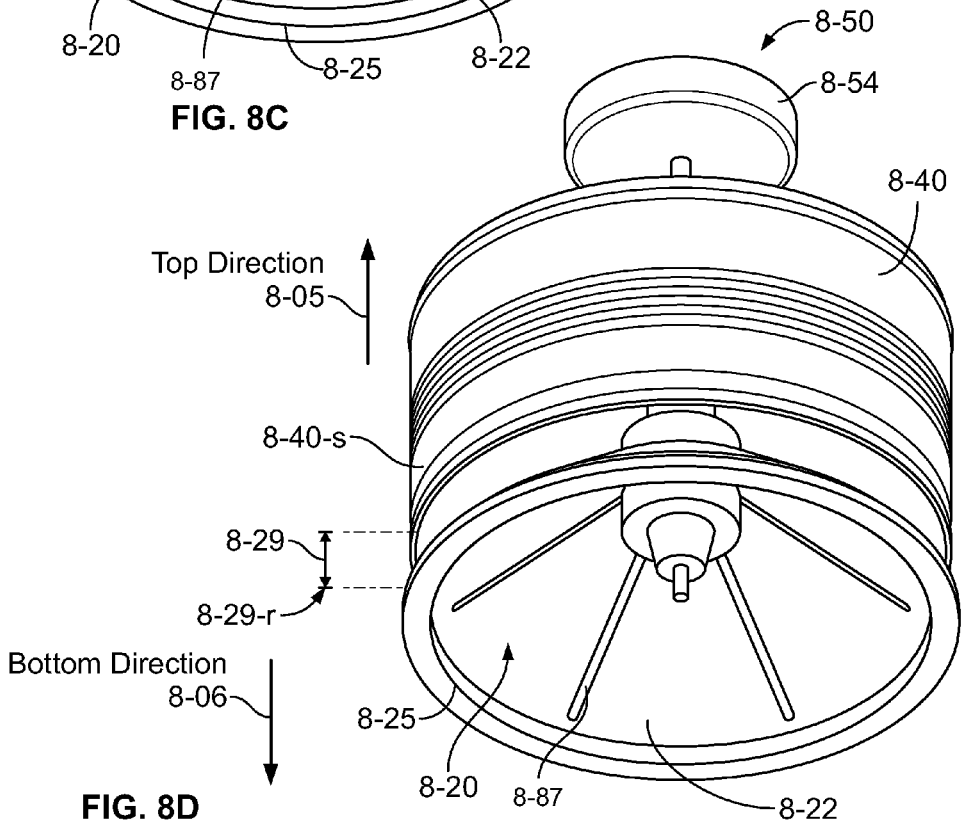
FIG. 8D shows a bottom perspective of an automatic stovetop fire suppressor in an activated state with ribs, in accordance with an exemplary embodiment of the present invention.

FIG. 8D shows a bottom perspective of the automatic stovetop fire suppressor in FIG. 8C in an activated state, in accordance with an exemplary embodiment of the present invention. Although the fire suppressor is shown in an activated state, the fuse 8-10 is shown in its inactivated state for illustration. Upon activation of the automatic stovetop fire suppressor the cone shaped bottom lid 8-20 drops below a bottom 8-06 edge of the side wall 8-40-*s* creating a radial opening 8-29*r*. The limit of the drop height 8-29 is further described above with reference to FIGS. 3A and 3B. In practice, the mounting assembly 8-50 remains secured above the stovetop surface to for, example, a vent hood. In accordance with an exemplary embodiment, a magnet, not shown, housed in a magnet housing 8-54 provides the connection of the stovetop fire suppressor and a vent hood. The circumferential channel 8-25 is shown displaced from a bottom 8-06 edge of the cylindrical side wall 8-40-*s* by a drop height of 8-29. In accordance with an exemplary embodiment the drop height is greater than 0.20 inches. Also shown are indents 8-87 on an outer side 8-22 of the cone shaped bottom lid 8-20. In an alternate exemplary embodiment, the cone shaped bottom lid does not have radial indents or ribs. In another embodiment, an inner surface, not shown, of the bottom lid 8-20 is textured.

Figure 9A:
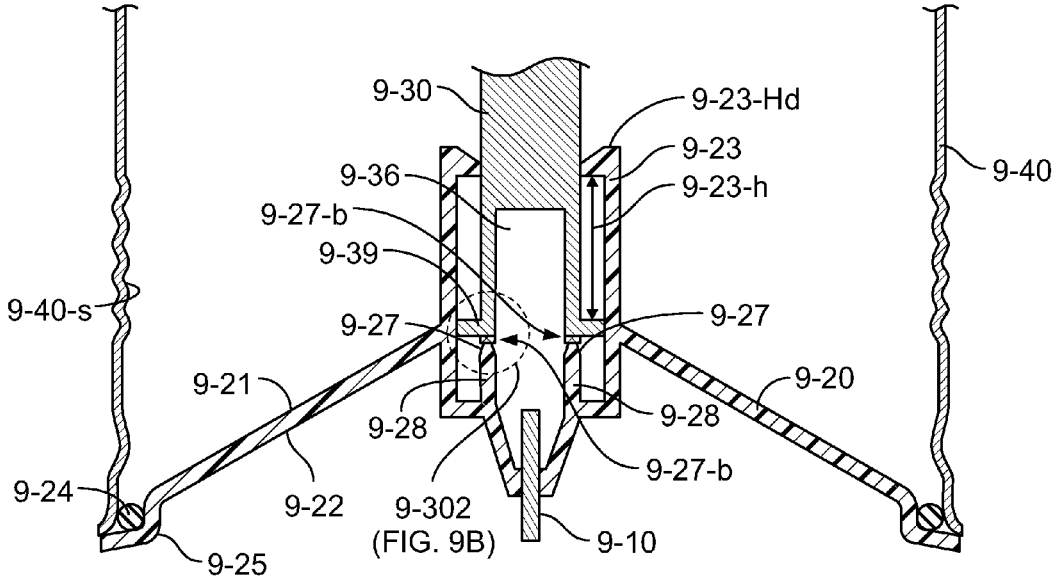
FIG. 9A shows a partial cross sectional view taken axial center of a stovetop fire suppressor in a closed state using a reduced cross sectional area at a connection across the lid and the initiator, in accordance with an exemplary embodiment of the present invention.

FIG. 9A shows a partial cross sectional view taken along axial center of a stovetop fire suppressor in a closed state using a reduced cross sectional area at a connection point across the lid and the initiator, in accordance with an exemplary embodiment of the present invention. An initiator housing 9-30 has a cavity for an initiator charge 9-36, In accordance with the exemplary embodiment of FIG. 9A, the initiator housing has shoulders, or a catching surface 9-39. The cone shaped bottom lid 9-20 has travel limit fingers 9-23 with head 9-23-Hd for catching the lid 9-20 on shoulder 9-39 upon device activation. Similar to the exemplary embodiment shown in FIG. 3B, the height 9-23-*h* of the travel limit members 9-23 can be increased or decreased to modify a drop height of the lid. In accordance with the exemplary embodiment shown in FIG. 9A, the travel limit fingers 9-23 are integral to the cone shaped lid 9-20 and are made of plastic. Likewise, the initiator housing 9-30 is made of plastic with shoulder 9-39 integral to the housing for catching of the travel limit fingers 9-23 upon activation. Both the lid 9-20 and the initiator housing 9-30 may be formed by thermo-molding.

A fuse 9-10 extends from the initiator charge 9-36 past an outer surface 9-22 of lid 9-20. At the outer edge of the lid 9-20 is a groove, a 90 degree angle, or a channel 9-25. A seal 9-24 is seated in the groove 9-25 and seals against an inner side of the container wall 9-40-*s* when the fire suppressor is in its closed and inactivated state, FIG. 9A. In accordance with an exemplary embodiment of the present invention, the seal 9-24 may be a rubber o-ring. The seal 9-24 prevents leakage of the fire suppressing agent but does not withstand initiator 9-30 activation pressure. Housed within the container 9-40 is a fire suppressing agent, not shown.

In accordance with the exemplary embodiment of FIG. 9A, the attaching member 9-28 may be secured to the initiator housing by, for example, an adhesive or by an ultrasonic weld 9-27-*b*. A reduced cross sectional area 9-27 is employed at the attachment point of the lid's 9-20 attaching member 9-28 to the initiator housing 9-30. This interface 9-302 is shown in more detail in FIG. 9B.

Figure 9B:
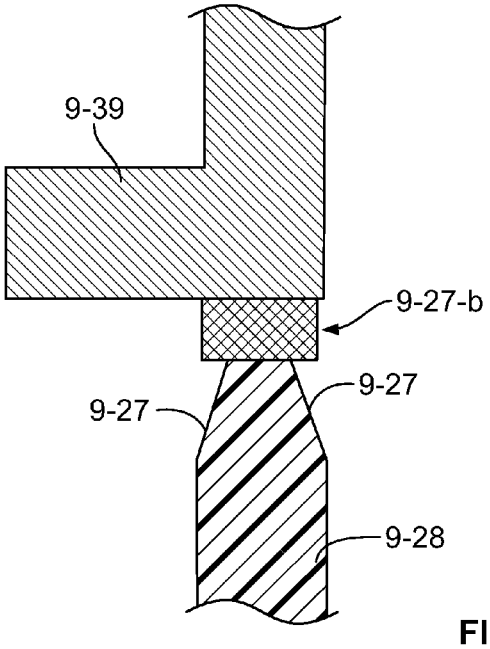
FIG. 9B shows an attachment portion of the cross sectional view of FIG. 9A in greater detail, in accordance with an exemplary embodiment of the present invention.

FIG. 9B shows an attachment portion of the cross sectional view of FIG. 9A in greater detail, in accordance with an exemplary embodiment of the present invention. The elements of FIG. 9B are not necessarily to scale. In practice, the adhering constituent 9-27-*b* may not be at the scale of the other elements of FIG. 9B. In accordance with the embodiment of FIG. 9B, under initiator charge induced activation pressure, the attaching member 9-28 breaks at the reduced cross section 9-27. In accordance with the embodiment of FIGS. 9A and 9B, shoulder 9-39 extends outwards from attachment point 9-27-*b*. In still alternate embodiments, in accordance with the present invention, the designed breaking point may be at another location in the attaching member, while still maintaining the integrity of the travel limiting members and the lid upon activation of the fire suppressor.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended drawings.

What is claimed is:

1. An automatic stovetop fire suppressor, the device comprising:
- a can comprising a top wall and a cylindrical sidewall;
- a plastic cone shaped bottom lid secured to a bottom of the can and forming a closed container;
- a fire suppressing agent housed in the closed container;
- an initiator housing secured to the top wall of the can; and
- an ultrasonic weld securing the cone shaped bottom lid to the initiator housing.

2. The device according to claim 1, further comprising:
- a fuse extending from an initiator charge housed in the initiator housing to an outer side of the cone shaped bottom lid.

3. The device according to claim 2, further comprising:
- an attaching member integral to the bottom lid and ultrasonically welded to the initiator housing; and
- a designed breaking point of reduced horizontal cross sectional area in the attaching member.

4. The device according to claim 1, further comprising:
- at least one travel limiting member integral to the bottom lid catching the bottom lid upon activation of the stovetop fire suppressor and limiting a drop height of the lid.

5. The device according to claim 4, wherein:
- the at least one travel limiting member is at least three mechanical fingers.

6. The device according to claim 5, further comprising:
- a catching surface on the initiator housing upon which mechanical fingers catch upon activation of the stovetop fire suppressor.

7. The device according to claim 5, further comprising:
- a catching surface on an inner side of a container sidewall upon which mechanical fingers catch upon activation of the stovetop fire suppressor.

8. The device according to claim 4, further comprising:
- the drop height is 0.20 inches.

9. The device according to claim 1, further comprising
- a seal between a bottom of a container side wall and a circumference of the bottom lid.

10. The device according to claim 9, wherein:
- the seal is an o-ring.

11. The device according to claim 10, wherein:
- the o-ring seats in a groove in a circumference of the bottom lid.

12. The device according to claim 1, further comprising:
- a circumferential channel in the bottom lid sealed to a bottom edge of a container side wall.

13. The device according to claim 1, further comprising:
- a 45 degree angle between a horizontal and the cone shaped bottom lid.

14. The device according to claim 1, further comprising:
- a four inch diameter of the cylindrical sidewall.

15. An automatic stovetop fire suppressor, the device comprising:
- a can comprising a top wall and a cylindrical sidewall;
- a plastic cone shaped bottom lid secured to a bottom of the can and forming a closed container;
- a fire suppressing agent housed in the closed container;

an initiator housing secured to the top wall of the can;

internal threads at a bottom of the initiator housing;

an attaching cylinder integral to the cone shaped bottom lid;

external threads in the attaching cylinder;

wherein, the internal threads mate with the external threads, forming the closed container.

16. The device according to claim 15, further comprising:

a designed breaking point of reduced horizontal cross sectional area in the attaching cylinder below the external threads.

17. The device according to claim 15, wherein:

the threads at the bottom of the initiator housing are external; and the threads in the attaching cylinder are internal.

18. The device according to claim 15, further comprising:

internal threads in a top of the initiator housing:

an insert disposed through the top wall;

external threads in a bottom of the insert;

shoulders of the insert disposed on an outer side of the top wall; and wherein, the internal threads in the top of the initiator housing mate with external threads in the bottom of the insert.

19. The device according to claim 18, wherein:

a mount for the automatic stovetop fire suppressor is mechanically connected to the insert.

* * * * *